United States Patent [19]

Crook

[11] Patent Number: 4,896,702

[45] Date of Patent: Jan. 30, 1990

[54] SEAM CONSTRUCTION FOR PAPERMAKING FABRICS

[75] Inventor: Robert L. Crook, Starkville, Miss.

[73] Assignee: Niagara Lockport Industries Inc., Quincy, Fla.

[21] Appl. No.: 279,040

[22] Filed: Dec. 1, 1988

[51] Int. Cl.[4] ..... D03D 23/00

[52] U.S. Cl. ..... 139/383 A; 24/31 H; 24/33 P; 162/358; 162/DIG. 1; 428/222; 428/223; 428/233; 428/234; 428/224

[58] Field of Search ..... 428/234, 222, 223, 233, 428/224; 162/DIG. 1, 358; 139/383 A; 24/31 H, 33 P

[56] References Cited

U.S. PATENT DOCUMENTS

| | | | |
|---|---|---|---|
| 1,828,304 | 10/1931 | Woodman . | |
| 3,478,991 | 11/1969 | Schiel et al. | 245/10 |
| 3,815,645 | 6/1974 | Codorniu | 139/383 A |
| 4,244,084 | 1/1981 | Gisbourne | 24/33 C |
| 4,574,435 | 3/1986 | Luciano et al. | 24/33 C |
| 4,695,498 | 9/1987 | Sarrazin et al. | 428/223 |
| 4,698,250 | 10/1987 | Talonen et al. | 428/234 |
| 4,764,417 | 8/1988 | Gulya | 428/223 |

*Primary Examiner*—James J. Bell

*Attorney, Agent, or Firm*—Pettis & McDonald

[57] ABSTRACT

A seamed papermaking fabric having a multilayer base fabric includes an endless woven fabric forming a tubular belt that is flattened to form a base fabric with at least one helical coil seaming member inserted between opposing sidewall portions at each respective lengthwise extremity of the base fabric. The helical axes of the seaming members extend transverse to the lengthwise direction of the fabric and the coils of the seaming member extend through spaces between adjacent machine direction yarns and supportably engage the machine direction yarns. The opposed lengthwise extremities of the base fabric are joined together by interengagement of the coils of the respective seaming members and insertion of the pintle member axially through the interengaged coils to form a seamed endless fabric of substantially twice the predetermined thickness.

18 Claims, 2 Drawing Sheets

SEAM CONSTRUCTION FOR PAPERMAKING FABRICS

BACKGROUND OF THE INVENTION

This invention relates to the field of seam construction for joining the ends of a length of papermaking fabric to render that fabric endless. More particularly, it relates to a seaming technique for use with a multilayer layer base fabric. Even more specifically, it relates to a helical coil seam for such a fabric.

Seamed papermaking fabrics, that is, those having seams that may be assembled and disassembled on a papermaking machine without the requirement of stitching or weaving, have been available but have presented problems, primarily in the premature failure of the seamed area. These prior art fabrics can be divided into two basic categories, the first having seams formed outside of the weaving loom and the second having seams formed in the weaving loom.

In the first category of fabrics, those having seams formed outside the weaving loom, the fabrics have generally been flat woven with an independent seam structure attached to the ends of the fabric, such as by sewing a woven tape onto the fabric or piercing it with clipper hooks. These structures have provided poor caliper and density profiles in the seam area. Other structures, such as Gisbourne, U.S. Pat. No. 4,244,084, have formed a gap near the end of the fabric with the fabric end then folded back over a helical coil to lock the seam loops into the fabric. This structure again provides poor caliper and density profiles in the seam area due to the fold back thickness, and the strength and life of the seam is limited to the strength of the stitching holding the folded fabric. These problems have effectively precluded the successful use of any of these types of fabric seams in the wet press section of papermaking machines.

In the second category, in which a pin seam is formed during the weaving process on the loom, the conventional approaches have constructed such a seam by forming loops on two ends around holding cords and then weaving the yarn back into the fabric body. This seaming technique has suffered disadvantages in that the base fabric composition, construction and thickness have been dictated by the requirements of loop formation, as distinguished from papermaking considerations. This has required two layers of machine direction yarn that are capable of being heat set or resin impregnated to be stiff enough to form loops. Such construction has provided an improved seam compared to the first category but has still suffered many problems. These problems include installation difficulties because the seam loops are difficult to mesh together because of inconsistent size, shape and orientation as a result of the weaving method. Also, these seams tend to pull apart, due to machine direction yarn failure. This type of failure has resulted from the requirement of stiff yarns for loop formation, which yarns have intrinsically poor fatigue resistance and low elasticity and resiliency. Another significant problem relates to the requirement that the base fabric thickness be dictated by the method of loop formation and not be designed for optimal water handling and drainage. This frequently results in poor sheet dewatering, reduced paper machine efficiency, reduction in paper quality and a short operational life of the fabric. An additional problem relates to the substantial additional cost in weaving these difficult fabrics, resulting in press felt fabrics so woven being as much as 30% more expensive than comparable, nonseamed press felts.

SUMMARY OF THE INVENTION

As a result of difficulties noted above, it is an object of the present invention to provide an improved, seamed papermaking fabric in which the weave characteristics are dictated by the performance desired of the fabric and not the requirements of the seam and in which the load bearing yarn may be chosen for papermaking needs and not simply to form loops. Another object is to provide such a fabric in which the seam is formed outside the weaving loom and which is capable of using a seam material that does not require costly heat setting or resin impregnation of the base fabric. It is another object to provide such a fabric in which pin seams may be formed quickly and economically in a fabric that is engineered to have desirable papermaking characteristics. Yet another object of the present invention to provide a seamed papermaking fabric having a multilayer base fabric along with a removable pin seam. To achieve these, as well as other objects, the invention provides a seamed papermaking fabric having a multilayer base fabric, and it comprises an endless woven fabric forming a tubular belt having a sidewall of predetermined weave, thickness, width and length, as measured circumferentially around the tubular belt, with that belt being flattened to form a base fabric of twice the predetermined thickness with at least one helical coil seaming member inserted between the opposing sidewall portions at each respective lengthwise extremity of the base fabric, with the opposed lengthwise extremities of the base fabric being joined together by interengagement of the coils of the seaming members and insertion of a pintle member axially through the interengaged coils. The helical axis of each such seaming member extends transverse to the lengthwise direction of the fabric, and the coils of the seaming member extend through spaces between adjacent machine direction yarns and supportably engage the machine direction yarns to support the seaming member against forces supplied outwardly of the respective lengthwise extremities of the base fabric.

DESCRIPTION OF THE DRAWINGS

Several preferred embodiments of the fabric of this invention will be described in detail below in which.

DESCRIPTION OF A PREFERRED EMBODIMENT

Figure 6:
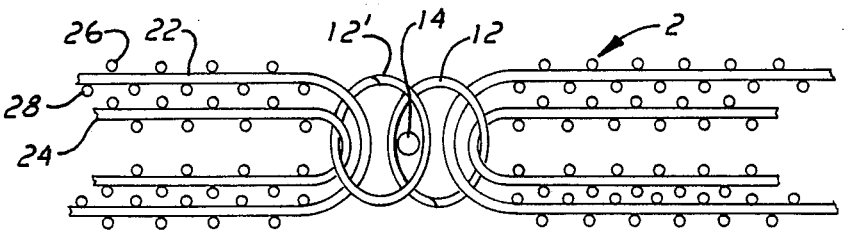
FIG. 6 is an elevational view of the seam of a fabric of another embodiment of the present invention.

A preferred embodiment of the papermaking fabric of the present invention, and the basic steps of making that fabric, are illustrated in FIGS. 1 through 4. The base fabric, generally indicated by reference numeral 2, is woven as an endless woven tubular belt having weft yarns 4, which will ultimately become machine direction yarns in the finished fabric, and warp yarns 6, which will become cross direction yarns in the completed fabric. In one example the warp yarns may be cabled nylon 610 monofilament, with the weft yarns being a three ply nylon 6, with a resin coating for enhanced stiffness and wear resistance. This base weave may conveniently be a four-shed (two by two) endless woven tubular belt having a predetermined width measured between axial edges of the belt and a predetermined length measured circumferentially around the tubular belt that is substantially twice the length of the desired finished fabric.

Figure 1:
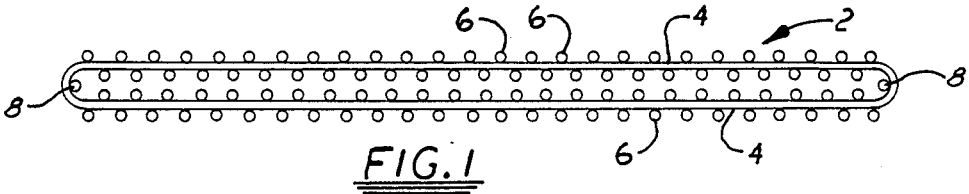
FIG. 1 is a simplified schematic representation of an endless woven fabric for use with this invention.

As shown in FIG. 1, the belt 2 preferably is woven with a removable cord 8 at each of opposing extremities of the slightly flattened tubular belt 2, as shown in FIG. 1. The fabric is woven to form the tubular belt 2, having its predetermined thickness and weave and a predetermined width measured between opposed axial edges, one of which is shown as edge 10 in FIG. 3, of the belt. This tubular belt 2 is then flattened to form a base fabric of substantially twice that predetermined thickness with the opposing portions of the sidewall of the tubular belt being closely adjacent one another. This provides such a flattened tubular belt having a flattened length between the lengthwise extremities thereof of about half the predetermined circumferential length.

Figure 4:
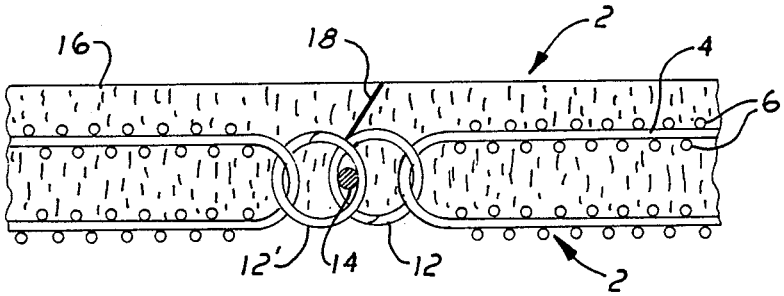
FIG. 4 is a schematic elevational view taken along line 4—4 of FIG. 3.

Upon removal of the cords 8 and, if necessary, adjacent warp yarns 6 proximal the lengthwise extremities of the flattened tubular belt 2, spiral coil seaming members 12 and 12′ are then inserted inside the tubular sidewall portion of the belt 2 where those cords 8 have been removed. The spiral seaming members 12 and 12′ may be formed of any of a number suitable synthetic materials, such as nylon or polyether-ethyl ketone (PEEK) and preferably has coil dimensions and spacing such that one loop of the coil projects between each adjacent pair of weft yarns 4, with the diameter of the coil being generally equal to or slightly less than the total thickness of the flattened tubular belt 2, as illustrated in FIG. 4. Thus, each of the coil seaming members 12 and 12′ engages each of what become the machine direction yarns 4, with the helical axis of the seaming members 12 extending transverse to the lengthwise direction of the base fabric and supportably engaging the machine direction yarns to support that seaming member against force applied outwardly of the respective lengthwise extremities of the base fabric. Preferably also, the two coils 12 and 12′ are of identical pitch, diameter and material, but are wound oppositely, one being a left hand helix and the other being a right hand helix, to provide for intermeshing in a manner to be described below.

Figure 2:
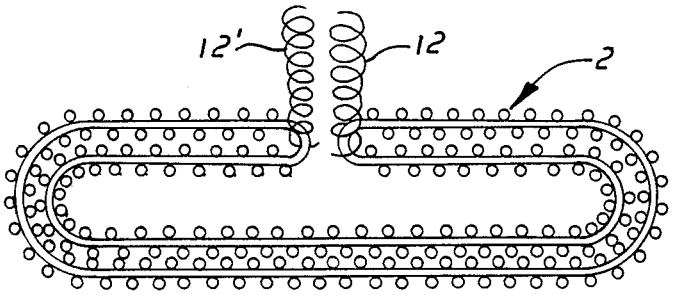
FIG. 2 illustrates the steps of insertion of the helical coil seaming members into a flattened endless woven fabric of FIG. 1.
Figure 3:
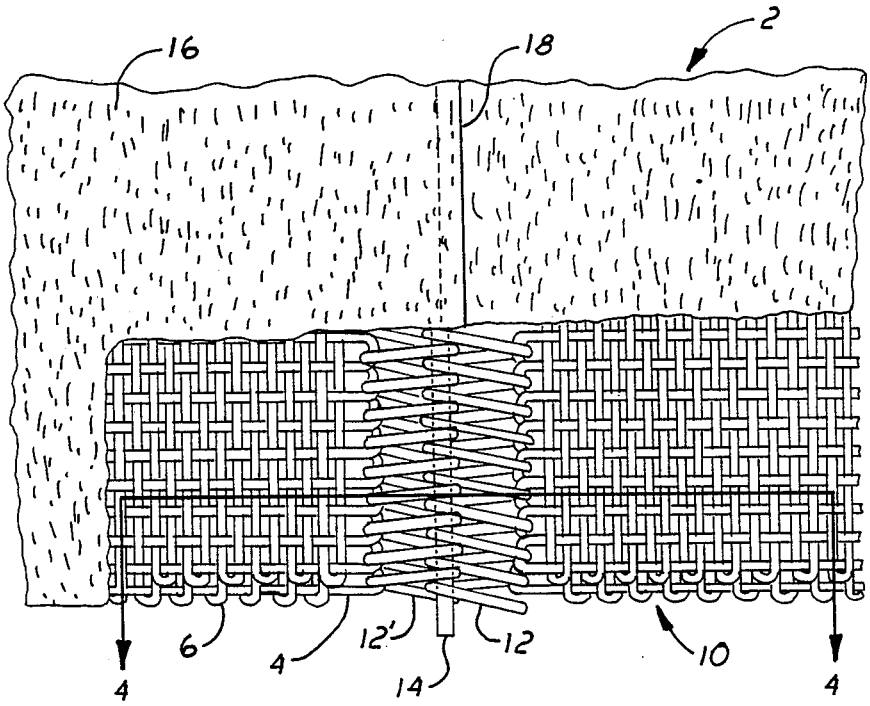
FIG. 3 is a fragmentary top plan view, partially in section, of a fabric manufactured according to the present invention, including a felt batt needled into the base fabric.

As shown in FIGS. 2, 3 and 4, the lengthwise extremities of the flattened tubular belt 2 are then brought together with the respective coils 12 and 12, interengaging one another and a pintle member 14 is inserted through the interengaged coil to lock them together to form a continuous looped base fabric, with the coils 12 and 12′ maintaining the thickness of the base fabric at the seam.

If the fabric is to be used as a sheet forming fabric, without additional batt being needled into the base fabric, it may now be mounted to a papermaking machine by removal of a pintle 14, placing the fabric around the papermaking rollers and reinsertion of that pintle member 14, rendering the structure ready for use. However, the advantageous characteristics of the fabric of this invention enable it to be used in fabricating a press felt for the wet press portion of a papermaking operation. To complete fabrication of the press felt, a suitable batt 16 is needled into and through one side, preferably the sheet forming side, of the flattened tubular base fabric 2, as shown in FIGS. 3 and 4. This needling conveniently continues over the seam portion to provide a continuous batt surface without a gap at the seam. A simple butt splice 18 may be cut through the batt at the seam area to enable the fabric to be opened at the seam by removal of the pintle 14. Such needling of the batt 16 not only applies that batt but also served to lock together the two base fabric sidewall portions to form a needled, seamed, double layer laminated wet press felt. If desired, the batt may be needled into the base fabric in a manner to cause the batt to project outwardly of both the sheet forming side and the machine side of the fabric, to reduce wear on the machine side.

of the use of this invention, where the warp yarn is two ply, two cable, 0.008 nylon woven at 16 yarns to the inch, and the weft yarn is an 840 denier, 3 ply nylon woven to provide about 20 yarns per inch in the final fabric, the base fabric weight using the construction of this invention was about 2.5 oz./sq.ft., although weights up to more than 3.0 oz./sq.ft. are also available. Thus, a press felt at a finished weight of 6.0 oz./sq.ft. may consist of between 48% and 58% batt compared to prior art seamed felts that are at least 65% batt. This construction thus provides for a lower level of compaction and filling of collapsed batt structure, which would limit water drainage.

Figure 5:
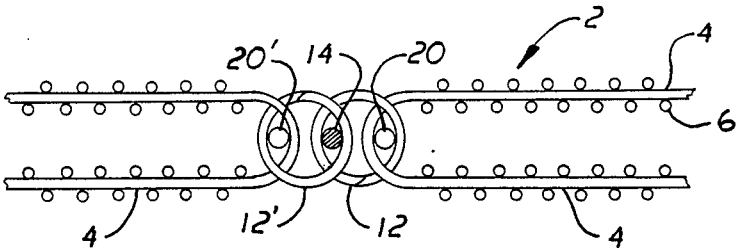
FIG. 5 is a schematic elevational view of the seam of a fabric similar to that illustrated in FIG. 4 but with additional cushioning elements.

FIGS. 5 through 8 illustrate additional improved embodiments of the fabric of this invention. For example, in FIG. 5 the seam structure is further improved by the insertion of cushioning yarns 20 and 20′ axially within each respective helical coil 12 and 12′ and interposed between the coils of the seaming members 12 and 12′ and the adjacent machine direction weft yarn 4 of the base fabric 2. These cushioning yarns, which may conveniently be a spun nylon yarn of about 400 denier, cushion engagement between the machine direction yarns 4 and the seaming member coils 12 and 12′ to reduce possible abrasion of the yarns 4 by the coils 12 and 12′. While the papermaking fabric of FIG. 5 is shown without the felt batt shown in FIG. 4, it is to be understood that such batt may be used with this alternative structure of FIG. 5 with equal facility.

Figure 7:
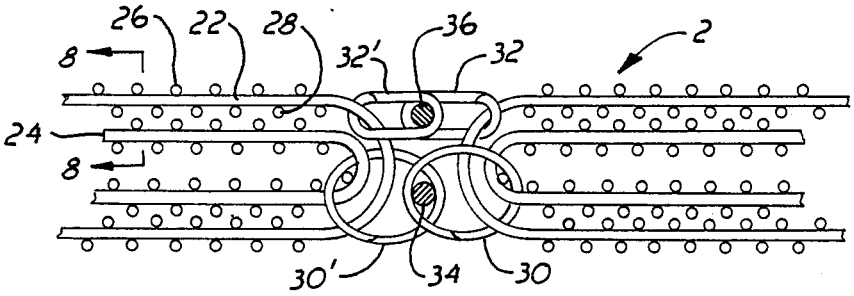
FIG. 7 is a schematic elevational view of a multiple pin seam variation of the fabric of FIG. 6.
Figure 8:
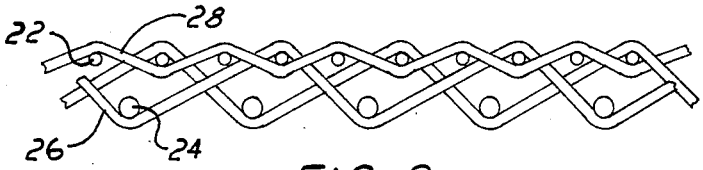
FIG. 8 is a sectional view taken along line 8—8 of FIG. 7.

As shown in FIGS. 6 through 8, the seaming technique of the present invention may also be utilized to create papermaking fabric having more than two layers of the base fabric. Instead of weaving the original tubular base fabric to have a single layer sidewall, as in FIG. 1, the fabric may be originally woven as a multilayer endless, tubular fabric having at least two layers of machine direction weft yarns, such as radially outer yarns 22 and radially inner yarns 24, along with cross direction warp yarns 26 and 28. If desired, both the radially inner layer 22 and radially outer layer 24 of machine direction weft yarn may have substantially the same weave with substantially the same number of such yarns per inch, as represented in FIG. 6. Alternatively, as shown in FIGS. 7 and 8, the weave engaging the radially outer layer of machine direction yarns 22 may be different, and suitably may be a finer weave than that of the radially inner layer of machine direction yarns 24, to provide a finer surface for supporting paper to be formed thereupon.

In the embodiment illustrated in FIG. 6, the helical coil seaming members 12 and 12′ are inserted at each lengthwise extremity of the base fabric 2 with the coils of those seaming members extending through spaces between and supportably engaging adjacent machine direction yarns of all, in this case two, layers of the machine direction yarns 22 and 24. As with the embodiment of FIGS. 1 through 4, the coil seaming members 12 and 12′ are selected such that the diameter of the coil is substantially equal to or slightly smaller than the total flattened thickness of the base fabric 2, that is, less than or about equal to twice the thickness of the sidewall of the fabric as it is originally woven, before flattening. The ends of the flattened tubular base fabric 2 are joined together by intermeshing of the coil seaming members 12 and 12′ and the insertion of a pintle member 14, as with the embodiment of FIGS. 1 through 4. If the fabric is to be used as a press felt, felt batt may be needled into the base fabric in the same manner as described with respect to FIGS. 3 and 4.

The fabric illustrated in FIGS. 7 and 8 represents yet a further improvement in use of the seaming technique of this invention. As noted above, the radially outer layer of machine direction yarns 22 in this embodiment may be of smaller diameter than the radially inner layer of machine direction yarns 24 to provide for improved sheet smoothness in the paper formed thereupon while maintaining substantial strength by virtue of the larger yarns 24 of the radially inner layer of machine direction yarns. As with the other embodiments, this fabric is woven endless using a stratified double layer weave as shown in the sectional view of FIG. 8, taken along line 8—8 of FIG. 7. As with the other embodiments, the endless woven tube is flattened with the ends brought together as shown in FIG. 7. In a manner analogous to that of FIG. 6, a first helical coil seaming member 30 is inserted from within the endless woven loop fabric with the coils thereof extending through spaces between and supportably engaging machine direction yarns of all of the layers of the machine direction yarns 22 and 24 at one lengthwise extremity of the base fabric 2. A corresponding first helical coil seaming member 30′ is likewise inserted in a similar manner at the opposite such lengthwise extremity of the base fabric, also engaging all layers of the machine direction yarns. Additionally, a second heical coil seaming member 32 is inserted into the base fabric with the coils thereof extending through spaces between and supportably engaging machine direction yarns 22 of fewer than all layers of the machine direction yarn in this case only the outer layer of machine direction yarns 22. At the opposite lengthwise extremity of the base fabric 2 a corresponding second helical coil seaming member 32′ is likewise inserted, engaging machine direction yarns 22 of fewer than all of the layers of the machine direction yarn.

To join the ends of the fabric of FIG. 7 together, the corresponding seaming members 30 and 30′ and 32 and 32′ at each lengthwise extremity of the base fabric 2 are interengaged, and respective pintle members 34 and 36 are inserted axially through the interengaged coil seaming members. This forms a multiple element pin seam with each pair of the interengaged seaming members and inserted pintle members providing backup support for the other interengaged seaming members and inserted pintle members. Suitably, the number of coils per inch of axial length of both of the first seaming members 30 and 30′ is substantially equal to the number of machine direction yarns 24 per inch of the radially inner layer of machine direction yarns as measured transverse to the lengthwise direction of the base fabric. Likewise, the number of coils per inch of axial length of both of the second seaming members 32 and 32′ preferably is substantially equal to the number of machine direction yarns 22 per inch of one of the layers of machine direction yarns other than the radially inner layer, in this case the radially outer layer, as measured transverse to the lengthwise direction of the base fabric. In this embodiment the diameter of the coils of the second seaming members 32 and 32′ is smaller than the diameter of the coils of the first seaming members 30 and 30′.

By the fabric manufacturing techniques described above, there is provided a papermaking fabric having a removable pin seam that results in little or no change in fabric homogeneity in the seam area. Additionally, this invention provides virtually unlimited selection of machine direction yarn sizes and composition, unlike conventional loop seaming techniques. The invention further permits single and multiple machine direction yarn layers, so that the seamed fabric can be engineered for the characteristics desirable for the specific papermaking application, eliminating concern relating to the creation of a pin seam. As described with respect to FIGS. 6 through 8, this structure provides for superimposed base fabrics with helical coil pin seams for enhanced sheet quality, along with capability of using multiple, superimposed coil seaming elements for enhanced smoothness and strength, even providing a backup joint in case one fails. By this technique the helical coil seaming members can also be inserted into conventional endless woven fabrics without special equipment and without requiring heat setting or resin impregnation on the ends of the fabric. Thus, it may be seen that the foregoing structure and seaming method provide a significant improvement in both the fabrication and installation of papermaking fabrics.

While the foregoing describes in detail certain illustrative embodiments of the invention, it is to be understood that these descriptions are illustrative only of the principles of the invention are not to be considered limitative thereof. Because numerous modifications and variations of the structure will readily occur to those skilled in the art, including the use of numerous other types of weaves and numbers of seaming coils, as well as other variations, the scope of the invention is to be limited solely by the claims appended hereto.

What is claimed is:

1. A seamed papermaking fabric having a multilayer base fabric and comprising an endless woven fabric forming a tubular belt having a sidewall of predetermined width measured between opposed axial edges of said tubular belt, predetermined length measured circumferentially around said tubular belt, predetermined weave, and predetermined thickness;

said tubular belt being flattened to form a base fabric of substantially twice said predetermined thickness with opposing portions of said tubular belt sidewall adjacent one another and having a flattened length between lengthwise extremities of said base fabric of about half said predetermined circumferential length;

at least one helical coil seaming member inserted between said opposing sidewall portions at each respective lengthwise extremity of said base fabric, with the helical axis of said seaming member extending transverse to the lengthwise direction of said fabric, and the coils of said seaming member extending through spaces between adjacent machine direction yarns and supportably engaging said machine direction yarns to support said seaming member against force applied outwardly of said respective lengthwise extremity of said base fabric;

said opposed lengthwise extremities of said base fabric being joined together by interengagement of said coils of the respective said seaming members and insertion of a pintle member axially through said interengaged coils to form a seamed endless fabric of substantially twice said predetermined thickness.

2. The fabric of claim 1 wherein the outside diameter of each of said helical coil seaming members is less than twice said predetermined thickness, whereby the outside diameter of the coil seaming member is less than the total thickness of the base fabric.

3. The fabric of claim 1 further comprising a cushioning yarn extending axially within each said helical coil seaming member and interposed between said coils of said seaming member and said adjacent machine direction yarns of said fabric belt to cushion engagement between said yarns and said seaming member coils.

4. The fabric of claim 3 wherein said cushioning yarn comprises spun nylon yarn.

5. The fabric of claim 1 wherein said predetermined weave of said endless woven tubular belt comprises a weave having a single layer of machine direction yarns, whereby the flattened tubular base fabric forms a double layer fabric with the coil seaming members inserted between the two layers.

6. The fabric of claim 1 wherein said predetermined weave of said endless woven tubular belt comprises a weave having a plurality of layers of machine direction yarns, whereby the flattened tubular base fabric forms a fabric having more than two layers of weft yarns, including a radially outer layer and at least one radially inner layer with at least one helical coil seaming member at each of the opposed ends of the flattened tubular belt extending through and engaging yarns from all layers of said weft yarns to form a base fabric having more than two layers.

7. The fabric of claim 1 wherein said predetermined weave of said endless woven tubular belt comprises a weave having at least two layers of machine direction yarns including a radially inner layer and a radially outer layer of said tubular belt, and said fabric further comprises a plurality of said helical coil seaming members inserted at each lengthwise extremity of said base fabric, with said coils of at least a first said seaming member extending through spaces between and supportably engaging adjacent machine direction yarns of all said layers of said machine direction yarns of the respective lengthwise extremity of said base fabric, and said coils of at least a second said seaming member extending through spaces between and supportably engaging adjacent machine direction yarns of fewer than all said layers of said machine direction yarns of said respective lengthwise extremity of said base fabric, whereby interengagement between pairs of corresponding seaming members, one at each lengthwise extremity of the base fabric, and insertion of respective pintles therethrough, provides for a multiple element pin seam with each pair of interengaged coil seaming members and inserted pintle providing backup support for the other interengaged coil seaming members and inserted pintles.

8. The fabric of claim 7 wherein the number of said coils per inch of axial length of both of said first seaming members is substantially equal to the number of machine direction yarns per inch of said radially inner layer of machine direction yarns measured transverse to the lengthwise direction of said base fabric.

9. The fabric of claim 7 wherein the number of said coils per inch of axial length of both of said second seaming members is substantially equal to the number of machine direction yarns per inch of one of said layers of machine direction yarns other than said radially inner layer, as measured transverse to the lengthwise direction of said base fabric.

10. The fabric of claim 7 wherein said weave has two layers of said machine direction yarns including said radially inner layer and said radially outer layer, and each said lengthwise extremity of said base fabric includes a first said first seaming member extending through and supportably engaging both said layers of said machine direction yarns, with each said first seaming member interengaging both the other said first seaming member at the opposed lengthwise extremity of said base fabric and a first pintle extending axially through said first seaming members, and a second said second seaming member extending through said supportably engaging only said radially outer layer of machine direction yarns with each said second seaming member interengaging both the other said second seaming member at the opposed lengthwise extremity of said base fabric and a second pintle extending axially through both said second seaming members.

11. The fabric of claim 10 wherein the diameter of of said coils of said second seaming members is smaller than the diameter of said coils of said first seaming members.

12. The fabric of claim 10 wherein the number of said coils per inch of axial length of both of said second seaming members is substantially equal to the number of machine direction yarns per inch of said radially outer layer of machine direction yarns measured transverse to the lengthwise direction of said base fabric.

13. The fabric of claim 1 wherein said seamed fabric has a machine side and a sheet side and wherein said sheet side includes a layer of batt affixed to said fabric and extending outwardly from said sheet side of said base fabric, whereby is formed a papermaking felt fabric.

14. A method of making a seamed papermaking fabric having a multilayer base fabric, comprising the steps of endless weaving a tubular belt fabric having a
predetermined width measured between opposed axial edges of said tubular belt,
predetermined length measured circumferentially around said tubular belt,
predetermined weave, and
predetermined thickness;

flattening said tubular belt to form a base fabric of substantially twice said predetermined thickness with opposing portions of the sidewall of said tubular belt being closely adjacent one another and said flattened tubular belt having a flattened length between lengthwise extremities thereof of about half said predetermined circumferential length;

inserting at least one helical coil seaming member between said opposing sidewall portions at each respective lengthwise extremity of said base fabric, with the helical axis of said seaming member extending transverse to the lengthwise direction of said base fabric and the coils of said seaming member extending through spaces between adjacent machine direction yarns and supportably engaging said machine direction yarns to support said seaming member against force applied outwardly of said respective lengthwise extremity of said base fabric; and joining together said opposed lengthwise extremities of said base fabric by interengagement of said coils of the respective said seaming members and insertion of a pintle member axially through said interengaged coils to form a seamed endless fabric of substantially twice said predetermined thickness.

15. The method of claim 14 further comprising insertion of a cushioning yarn axially within each said helical coil seaming member and interposed between said coil; of said seaming member and said adjacent machine direction yarns of said base fabric to cushion engagement between said yarns and said seaming member coils.

16. The method of claim 14 wherein said tubular belt fabric is woven to have at least two layers of machine direction yarns including a radially inner layer and a radially out layer, and said step of inserting said seaming members comprises insertion of a plurality of said seaming members at each said lengthwise extremity of said base fabric, including for each said extremity inserting at least a first said seaming member with the coils thereof extending through spaces between and supportably engaging adjacent machine direction yarns of all said layers of said machine direction yarns of the respective lengthwise extremity of said base fabric, and inserting at least a second said seaming member with the coils thereof extending through spaces between and supportably engaging adjacent machine direction yarns of fewer than all said layers of said machine direction yarns, and the corresponding said seaming members at each lengthwise extremity of said base fabric are interengaged and respective pintle members are inserted axially therethrough, whereby is formed a multiple element pin seam with each pair of interengaged seaming members and inserted pintle member providing backup support for the other interengaged seaming members and inserted pintle members.

17. The method of claim 16 wherein said tubular belt fabric is woven to have two layers of machine direction yarns, including said radially inner and said radially outer layer, and said step of inserting said seaming members comprises, for each said lengthwise extremity of said base fabric, inserting a first seaming member extending through and supportably engaging both said layers of said machine direction yarns, with each said first seaming member interengaging both the other said first seaming member at the opposed lengthwise extremity of said base fabric and a first pintle extending axially through said interengaged first seaming members, and inserting a second seaming member extending through and supportably engaging only said radially outer layer of said machine direction yarns, with each said second seaming member interengaging both the other said second seaming member at the opposed lengthwise extremity of said base fabric and a second pintle extending axially through said interengaged second seaming members.

18. The method of claim 14 wherein said seamed fabric has a machine side and a sheet side and wherein the method includes the step of affixing to said sheet side of said base a layer of batt to form a papermaking felt fabric.

* * * * *